United States Patent [19]

Basfeld

[11] Patent Number: 4,808,439

[45] Date of Patent: Feb. 28, 1989

[54] PROCESS AND APPARATUS FOR APPLYING AND IMPREGNATING FLEECE MATERIALS WITH VISCOUS LIQUIDS

[75] Inventor: Klaus Basfeld, Walsrode, Fed. Rep. of Germany

[73] Assignee: Wolff Walsrode Aktiengesellschaft, Walsrode, Fed. Rep. of Germany

[21] Appl. No.: 114,172

[22] Filed: Oct. 27, 1987

[30] Foreign Application Priority Data

Nov. 8, 1986 [DE] Fed. Rep. of Germany ..... 3638189

[51] Int. Cl.[4] ..... B05D 3/12; B05C 1/00; B05C 3/12; D01F 2/06

[52] U.S. Cl. ..... 427/356; 118/223; 118/405; 118/420; 427/358; 264/174; 264/188

[58] Field of Search ..... 118/404, 405, 408, 410, 118/411, DIG. 10, DIG. 11, 223, 420; 264/173, 174, 188; 426/135, 138; 427/358, 356

[56] References Cited

U.S. PATENT DOCUMENTS 3,709,720 1/1973 Kindl et al. ..... 264/188 X
4,390,490 6/1983 Martinek et al. ..... 427/358 X

*Primary Examiner*—Michael Lusignan
*Attorney, Agent, or Firm*—Sprung Horn Kramer & Woods

[57] ABSTRACT

Fleece materials are coated, in particular on both sides, with a viscous liquid by applying the viscous liquid to at least one side of a web from at least two dies.

10 Claims, 1 Drawing Sheet

PROCESS AND APPARATUS FOR APPLYING AND IMPREGNATING FLEECE MATERIALS WITH VISCOUS LIQUIDS

BACKGROUND OF THE INVENTION

The invention relates to a process and an apparatus for applying and impregnating fleece materials with viscous liquids.

A fleece material is herein to be understood in particular as meaning a structure of irregular texture, in which a hollow space structure nonuniformly distributed over the area is present. Such fleece materials can have as base material natural as well as artificially prepared fibres which are additionally stabilized by cross-linking with one another. Such structures are difficult to impregnate, in particular if the process of encapsulation is to take place very rapidly and without inclusion of air or gas.

Such a production stage is present for example in the manufacture of fibre-reinforced cellulose casings which are preferably prepared from a fleece web and viscose.

Cellulose casings are used for example in the packing of comestibles, in particular as sausage casings. In this area, a distinction is made between casings coated with viscose on one or both sides, depending on the way the application of viscose is carried out in the course of manufacture.

The form which is coated with viscose on both sides generally exhibits a better and more uniform encapsulation of the fibre fleece, provided it is possible to avoid air inclusions in the short time of application of viscose to both sides of the fleece. It will be readily understood that the controlled displacement of air is easier to carry out in the case of a one-sided coating, in particular since, after leaving the die in which the coating is applied, there is still a free section, to the start of coagulation, which permits the one-sided displacement of air from the fleece.

On the other hand, there are areas where only fleece-reinforced cellulose casings coated with viscose on both sides are sued in practice. They are in general the fibre skins which have been lacquered on the inside with a barrier layer. The inner surface of the casing has a cellulose layer for reasons of lacquerability, while the outer surface has a cellulose covering for visual reasons. The customarily dope-dyed regenerated cellulose present on the outside provides optimal cover for the fibrous structure. This type of casings is widely used in the making of scalded and boiled sausages.

It has further been found that even in the case of unlaquered material there are in many areas significant advantages on the side of using material coated on both sides with viscose. For instance, in the event of high internal friction in the filling process the sliding behaviour with casings having an inside layer of cellulose is significantly more favourable on account of the excellent surface smoothness. Such is the case with uncooked sausage meat fillings or with skins for covering hams. Additional sliding impregnations which are necessary in the case of one-sided application of viscose to the outside can be dispensed with. The application of viscose to both sides also ensures a more uniform overall structure which is valued on account of the excellent peeling behaviour and the more uniform dilation of the casing in particular in the case of cold cuts which are packaged a second time.

These examples show the importance which two-sided coating with viscose already has and which will be increased if it is possible, in particular, to obtain the manufacturing advantages of one-sided coating with viscose. The two-sidedly viscose-coated cellulose casings in tube form which are customary today are manufactured, in general, by first forming a web of fibre fleece into a tube. This tube is coated on both sides with viscose in the coating means (GB No. 1336850). The viscose is applied almost simultaneously in this case because of the decrease in strength on wetting the customarily preferably used natural fibre fleece with viscose. Coating is effected with die systems which consist of an outer and an inner annular die. The viscose is applied under pressure via these annular dies in predetermined amounts. The reason it is difficult to impregnate the fleece without including air is that highly viscous aqueous liquids are concerned here.

The viscosity of the viscose is essentially determined by the solids content in terms of cellulose and the degree of polymerization. The higher these two values, the higher the viscosity. To process viscose, a low viscosity is desirable for rapid and optimal impregnation of the fibre fleece. However, the quality of the end product grows with a high solids content and degree of polymerization. The degree of polymerization determines the shrinkage behaviour and the elasticity of the regenerated cellulose, while the solids content determines the porosity and, in conjunction with the degree of polymerization, the final strength of the casting. The manufactured article is consequently a comprise which usually has a solids content which is actually too low.

To avoid the difficulties in the case of the twosided coating with viscose, the viscoses used have a solids content of 6.5 to 7% by weight, that is a solids content which is not optimal.

SUMMARY OF THE INVENTION

The present invention had for its object to provide an improved apparatus and improved process in particular for the two-sided coating of fleece materials.

The invention provides an apparatus for coating and impregnating fleece materials, in particular on both sides, with a viscous liquid, comprising preferably at least one applicator die on each side of the web of the fleece material, characterized in that on at least one web side A at least two dies D1 and D3 are arranged in a stagger in the transport direction. In a preferred embodiment, a die D2 is arranged for backcoating duty on web side I opposite to web side A, preferably between the dies D1 and D3.

In a particularly preferred embodiment, web side A is the outer web side of the fleece material. The dies are preferably annular slot dies whose exit opening has a width of 0.3 to 6 mm. The dies D1 and D3 are preferably staggered with respect to each other by about 2 mm to 8 mm.

The invention further provides a process for coating and impregnating fleece materials with a viscous liquid, in particular on both sides, comprising preferably at least one die for each web side of the fleece material, on at least one web side A the viscose fluid being applied by at least two dies D1 and D3. Die D3 is arranged in a stagger in relation to die D1 in the transport direction; the fleece is thus first coated by die D1 and only then by die D3. The backcoating of web side I is preferably carried out with a die D2, preferably situated opposite the die lip common to dies D1 and D3. In a preferred embodiment, application onto any desired area through die D2 takes place about 0 to $2\times10^{-2}$ seconds later than application through die D1. In a further preferred embodiment, the viscous liquid emerges from die D3 under a higher pressure than from die D1. In a very particularly preferred embodiment, the exit pressure from the die is controlled in such a way that the fleece web to be coated is moved by the staggered pressure build-up in the direction of the exit from the coating means.

The viscous liquid is preferably alkali cellulose (=viscose). It preferably has a viscosity of 300 to 500 falling ball seconds in particular from 350 to 400 falling ball seconds. In this connection, 310 falling ball seconds corresponds to 40,000 mPa.s. The solids content of the viscous liquid is preferably 7.5 to 9.0% by weight. The viscous liquid can contain additives which improve appearance and properties, for example coloured pigments, tackifiers or release agents, and also substances which regulate the adhesive and reactive properties.

The manufacturing process according to the invention for a cellulose casing preferably proceeds as follows:

The web, which is cut out of fibre fleece depending on the viscose tube diameter to be manufactured, is formed into a tube having an overlap. In the apparatus according to the invention, the tube is in this case preferably impregnated and coated on both sides with viscose. After passing through an air passage, the viscose-coated fibre fleece tube arrives in a coagulation bath, where the viscose is coagulated to obtain regenerated cellulose. The regenerated cellulose is then washed, passed through a softener bath and dried under supporting air. In this step, the amount of water to be evaporated is dependent on the level of the solids content in terms of cellulose in the viscose. Higher solids content means lower water content, which is thus a further reason for wanting to process high solids contents via a die.

The coating according to the invention is preferably effected in cascade style beginning with a coating of the outside via an annular die. By splitting up the outer viscose, the pressure on the fibre fleece is systematically increased, and on passing through the coating means the full pressure loading is only reached at the end of the annular gap which exists between the die bodies inside and outside relative to the fleece web guide. At the same time the fibre fleece is guided floatingly through the viscose and transported by means of an outflowing viscose through the die combination without significant exposure to friction. Astonishingly, as a result of splitting up the viscose the pressure increase on the fibre fleece is optimized in such a way that a tension-free structure of the viscose-coated material is obtained even in the case of thin fibre fleeces.

With the known manufacturing processes, it is customary for small and larger tension creases to form in the viscose tube. They are formed as a consequence of the tensile force acting on the viscose-coated tube underneath the die, caused essentially by friction from the dies in the application of viscose. They are a sign of production unreliability, can lead to unnecessary loss of production and interfere with the uniformly visual appearance of the completed product. These disadvantages can be avoided according to the invention.

A preferred apparatus according to the invention is described hereinafter with regard to the attached drawing wherein:

DETAILED DESCRIPTION OF THE INVENTION

Figure 1:
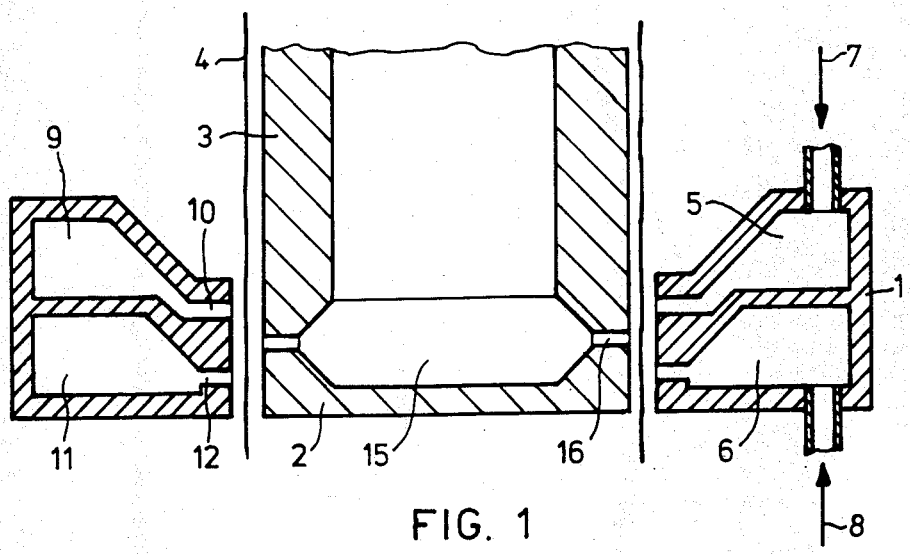
FIG. 1 depicts a cross-section through a coating apparatus
Figure 2:
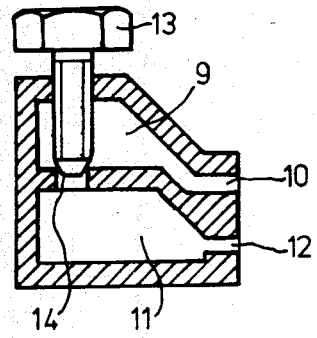
FIG. 2 depicts a die half with simplified viscose distribution

The application of viscose is effected in the apparatus of FIG. 1. The fibre fleece 4, formed into a tube, passes over a cylindrical calibrating mandrel 3. The tube passes between an outer die combination 1 and a corresponding inner die 2. The outer combination consists of two individual dies 5 and 6. The viscose is passed via a pump, not depicted, and feed line 7 into the annular chamber 9 of die 5, said annular chamber 9 being dimensioned in such a way that the pressure loss which occurs in the distribution of the viscose is negligible. The viscose, which is under pressure, flows via a narrow die slot 10 onto the fibre fleece. A similar outflow occurs from the second outer die 6 via feed line 8, annular chamber 11 and die slot 12. The feed lines 7 and 8 can be fed with viscoses having different properties. In the normal case, where a single type of viscose is used, a single feed line will be present, for example in annular chamber 11, and the feed to the second annular chamber 9 is effected via an adjustable annular opening 14 (FIG. 2). The adjustment of cross-section 14 is effected via a screw 13. In this way, it is a simple matter to effect an optimization of the splitting of the viscose during production.

Separately from the outer dies, the inner die 2 is fed via a viscose supply line, not depicted. Via the collecting space 15, the viscose passes into the die slot 16, and from there under pressure onto the fibre fleece 4.

Figure 3:
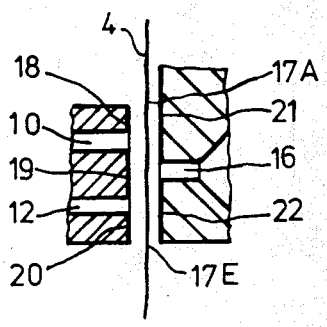
FIG. 3 depicts a magnified representation of the annular gap through which the fleece passes in the course of the coating.

FIG. 3 reveals the coating process and its working principle. The fibre fleece 4 first passes along the outer die lip 18 and is coated with viscose via die slot 10. The pressure is in general such that the viscose does not rise in annular gap 17 A. The high viscosity leaves deaeration channels free. In the zone of outer die lip 19 the backcoating is applied via inner die slot 16. Hence an encapsulation of the fleece is achieved without excessively high pressure. The inner die lip 21 ends below the die slot 10 for the purpose of giving optimal fleece support. The precoated fleece then passes into the pressure zone between die lips 19 and 20. The viscose flows on via die annular slot 12. Since the highest pressure drop is present along outer die lip 20, the viscose urges toward the exit via ring gap 17 E. Thereby the viscose moves the sensitive, now viscose-moist fibre fleece in the direction of die exit without imposing any stress on the fleece.

The advantages of the new coating system described over the customary dies particular are particularly large when employing viscoses of high viscosity, for example greater than 250 falling ball seconds. Particularly positive results are obtained in the range 300 to 500 falling ball seconds, where known processes are not satisfactory.

To obtain the cascadelike viscose loading with the wedge effect of the viscose pressure build-up, it is sufficient in practice to use the system described in the Example of double coating from the outside and single coating via the inner die. The reason the double coating is preferably on the outside is that these dies are more easily accessible for the viscose feed; the double coating system could of course also be positioned on the inside.

It is of course also possible to divide the viscose onto even more individual dies on the inside and outside if several viscose layers of different structures are required to obtain certain properties of the cellulose tube. In such an arrangement, the number of annular dies on the inside or outside can be an even or an odd number.

EXAMPLES

Example 1 (comparative example)

A fibre fleece of natural fibres having a paper weight per unit area of 21 g/m$^2$ and a cut width of 322 mm is coated with a conventionally produced viscose having the following data.

Solids content as cellulose: 7.7% by weight
Carbon sulphide used: 29% by weight on cellulose
Sodium hydroxide solution: 5.7% by weight
Degree of polymerization: 530

The viscosity of this viscose is 410 falling ball seconds at 20° C. This viscose is all but impossible to process at a manufacturing speed of 740 m/h using the customary viscose-coating system. Penetration is insufficient in the overlap area of the seam; air inclusions are visible. As a consequence of excessively high additional forces or frictional forces in the die the viscose is distributed highly unevenly on the fibre fleece. The completed product exhibits highly fluctuating bursting pressures.

Example 2

Example 1 is repeated, except that the viscose was applied according to the invention using an apparatus as depicted in FIG. 1. The coating speed was 750 m/h.

A smooth completely evenly impregnated cellulose tube is obtained.

The composition of the completed tube was:
18.1 g/m of cellulose
31% by weight of glycerol, relative to cellulose
7% by weight of water The cellulose tube was subjected to a bursting test with water. The tube burst under a super atmospheric pressure of 0.69 bar.

The fibre fleece encapsulation exhibited no air inclusions.

The subsequent lacquering was easier to carry out on the particularly flat surface than was the case with material produced using viscose of low viscosity and the customary die system.

Example 3

Example 2 is repeated using a cellulose casing formed from a fibre fleece having a paper weight per unit area of 17 g/m$^2$ and a cut width of 200 mm. The same good results are obtained.

Example 4

A one-sided coating is carried out with the die combination D1 and D3. In this process, the cylindrical calibrating mandrel 3 serves to support the fleece tube until the coating with viscose is complete. A viscose is applied via die D1 in accordance with Example 1. The viscose has additionally been coloured. The same viscose is applied via die D3. Coating is carried out at a speed of 800 m/h on a fibre fleece having a cut width of 206 mm and a paper weight per unit area of 21 g/m$^2$. A total fleece encapsulation is obtained with satisfactory impregnation of the seam. The layer of regenerated cellulose is uniform without colour stripes.

Example 5 (comparison)

The coating with the viscose is effected with the materials and the same processing speed as in Example 4. However, the die used is of the conventional type, having only one annular gap which is impinged on by viscose under pressure and via which viscose arrives on the fibre fleece.

In the case the cellulose skin does not exhibit complete incorporation of the fibres, unencapsulated fibres being clearly visible. The seam has not been sufficiently penetrated, and the casing breaks under pressure, which is why in addition an adhesive bonding of the seam is required in the viscose-coating process. The viscose distribution is nonuniformly distributed, as evident by the colour stripes.

I claim:

1. In an apparatus for coating and impregnating fleece materials with a viscous liquid comprising means for moving the fleece material in a transport direction and applicator dies for applying the viscous liquid, the improvement wherein at least two dies are arranged with one die downstream of the other die in the transport direction at one side of the fleece material.

2. The apparatus according to claim 1, further comprising a die arranged for backcoating duty on the other side of the web which is opposite the one side of the web.

3. The apparatus according to claim 2, wherein said one side of the web to an outer surface and the other side of the web corresponds to an inner surface.

4. The apparatus according to claim 3, wherein the dies are annular slot dies having an opening of 0.3–6 mm and the fleece material is in the form of a tube.

5. The apparatus according to claim 1, wherein the dies are spaced apart with respect to each other by 2 to 8 mm.

6. In a process for coating and impregnating fleece materials wherein a viscous liquid is applied using dies, the improvement comprising: moving the fleece material in a transport direction and applying the viscous liquid on one side of the fleece material by a first die and at least one second die disposed downstream of the first die in the transport direction.

7. The process according to claim 6, further comprising coating the other web side with another die.

8. The process according to claim 6, wherein the viscous liquid emerges from the downstream die under higher pressure than from the upstream die.

9. The process according to claim 6, wherein the exit of the viscous liquid from the dies is controlled in such a way that the fleece web to be coated is moved in the direction of an exit from the coating means.

10. The process according to claim 6, wherein the viscous liquid is viscous.

* * * * *

UNITED STATES PATENT AND TRADEMARK OFFICE

CERTIFICATE OF CORRECTION

PATENT NO. : 4,808,439

DATED : February 28, 1989

INVENTOR(S) : Klaus Basfeld

It is certified that error appears in the above-identified patent and that said Letters Patent is hereby corrected as shown below:

| | |
|---|---|
| Col. 1, line 43 | Delete "sued" and substitute --used-- |
| Col. 2, line 30 | Delete "casting" and substitute --casing-- |
| Col. 2, line 33 | Delete "twosided" and substitute =-two-sided-- |
| Col. 5, line 24 | Delete "740" and substitute --750-- |

Signed and Sealed this

Fifth Day of December, 1989

*Attest:*

JEFFREY M. SAMUELS

*Attesting Officer*

*Acting Commissioner of Patents and Trademarks*